US006829320B2

(12) United States Patent
Colvill

(10) Patent No.: US 6,829,320 B2
(45) Date of Patent: Dec. 7, 2004

(54) COUNTING AND TABBING APPARATUS

(75) Inventor: Edward Colvill, Ipswich (GB)

(73) Assignee: Vacuumatic Limited, Essex (GB)

( * ) Notice: Subject to any disclaimer, the term of this patent is extended or adjusted under 35 U.S.C. 154(b) by 140 days.

(21) Appl. No.: 10/344,184

(22) PCT Filed: Jul. 31, 2001

(86) PCT No.: PCT/GB01/03449

§ 371 (c)(1),
(2), (4) Date: Feb. 7, 2003

(87) PCT Pub. No.: WO02/14197

PCT Pub. Date: Feb. 21, 2002

(65) Prior Publication Data

US 2003/0165214 A1 Sep. 4, 2003

(30) Foreign Application Priority Data

Aug. 11, 2000 (GB) ..... 0019543

(51) Int. Cl.[7] ..... G06M 11/00
(52) U.S. Cl. ..... 377/8; 270/58.32; 209/551
(58) Field of Search ..... 370/58.32; 209/551; 377/8

(56) References Cited

U.S. PATENT DOCUMENTS 5,612,984 A * 3/1997 Fuller et al. ..... 377/8
5,696,802 A * 12/1997 Hafezan ..... 377/8

FOREIGN PATENT DOCUMENTS

GB 1 041 049 A * 9/1966

* cited by examiner

*Primary Examiner*—Margaret R. Wambach
(74) *Attorney, Agent, or Firm*—Andrus, Sceales, Starke & Sawall, LLP

(57) ABSTRACT

Apparatus for counting sheets in stack (17) thereof and inserting tabs (27) between the sheets at predetermined counts, as well as a tabbing method, uses a rotatable counting disc (10) engageable with an edge region of the stack and including a sheet transfer slot (12) to transfer the next sheet to be counted from one face of the disc to the opposed face, upon rotation of the disc. There are means (30) to count the number of sheets transferred and also to advance the disc relative to the stack, as the counting progresses. A tabber (31) is arranged to insert a tab (27) between two sheets of the stack (17) when a predetermined sheet count has been achieved, which tabber (31) projects a tab in a generally radially outward direction with respect to the disc (10), immediately adjacent one face (13) of the disc and in a timed relationship to the rotation thereof. The disc includes a tabbing recess (20) in its one face (13) and into which a projected tab is received for insertion between the last and next sheets to be counted, at the moment of projection of the tab.

16 Claims, 8 Drawing Sheets

A
10
12
15
20
21
25
27
28
11

24
13
15'

22
23

17
16
14

COUNTING AND TABBING APPARATUS

CROSS-REFERENCE TO RELATED APPLICATIONS

This application is the U.S. national stage application of International Application PCT/GB01/03449, filed Jul. 31, 2001, which international application was published on Feb. 21, 2002 as International Publication WO 02/14197 in the English language. The International Application claims priority of Great Britain Patent Application 0019543.8, filed Aug. 11, 2000.

This invention relates to counting apparatus arranged for the counting of the number of sheets in a stack thereof. In particular, the invention relates to such counting apparatus arranged to permit the insertion of a tab or marker between two sheets in the stack, after a pre-set number of sheets has been counted. The invention also relates to a method of tabbing sheets in a stack.

The counting apparatus of this invention is primarily intended to count sheets of paper, or paper-like materials, such as of plastics. Though the apparatus could be used to count other sheet-like materials, the invention will primarily be described with reference to the counting of sheets of paper either before or after printing, but it is to be understood that the invention is not limited to this use.

High speed sheet counters are already known, using a counting disc with at least one transfer slot (but usually several peripherally-spaced slots) from one face of the disc to the opposed disc face and through which sheets are transferred, one at a time. Each time a sheet is transferred, a count is incremented. The disc may count along a side edge of the stack of sheets or a corner region of that stack, depending upon the design. Examples of such counters are to be found for example in GB-1041049 and EP-0704079.

It is further known with sheet counters to insert a marker in the form of a short strip of paper or paper-like material, each time the count has incremented by a certain number—for example, every one hundred sheets. The markers are usually referred to as tabs, and the apparatus for inserting the tabs, either a tab-inserter or a tabber, depending upon the precise configuration of the apparatus. Hereinafter, the term tabber will be used exclusively, to cover both forms of such apparatus.

On account of the thickness of the counting disc, the part of the stack which has already been counted is displaced from the remainder of the stack still to be counted, in the region of the disc itself. Known tabbers rely on there being a gap between these two parts of the stack in the region of but externally to the disc so that a tab may be projected into that gap at the required moment, just as the required count has been reached. Such a tabber is described in WO 96/07609.

Typically, for a disc counter which engages a corner region of the stack, a tab is inserted diagonally across the corner, in effect tangentially to the s counting disc. Such a tab is held relatively insecurely in the stack and often is repositioned manually after counting. In addition, the use of a tabber significantly reduces the maximum counting speed of a disc counter, if mis-tabbing is to be eliminated. In any event, paper-jams can occur should a tab, which is relatively flexible along its length, not slide smoothly between the required two sheets so that the tab then blocks subsequent counting or tabbing actions.

It is a principal aim of the present invention to improve on the known forms of tabber, to allow high speed counting of sheets of paper or paper-like materials, whilst at the same time permitting reliable tabbing whenever a required count has been achieved.

According to a first aspect of the present invention, there is provided counting apparatus for counting sheets in a stack thereof, which apparatus comprises a rotatable counting disc engageable with an edge region of the stack and including a sheet transfer slot to transfer the next sheet to be counted from one face of the disc to the opposed face on rotation of the disc, means to count the number of sheets transferred from one face to the other, advancing means to effect relative movement between the disc and the stack along the length of the stack as the sheets are counted, and a tabber arranged to insert a tab into the stack between two sheets when the count means achieves a predetermined sheet count value which tabber projects a tab in a generally radially-outward direction immediately adjacent one face of the disc and in a timed relationship to the rotation thereof, and the disc includes a tabbing recess in said one face and into which a projected tab is received for insertion between the last and next sheets to be counted at the moment of projection of the tab.

According to a second aspect of this invention, there is provided a method of tabbing sheets in a stack thereof using a rotatable counting disc engageable with an edge region of the stack and including a sheet transfer slot through which the next sheet to be counted is transferred from one face of the disc to the opposed face on rotation of the disc, the count being incremented each time a sheet is transferred from one face to the other and the disc being advanced along the length of the stack as the sheets are counted, in which method a tabber is arranged to insert a tab into the stack between two sheets when the count achieves a predetermined sheet count value which tabber projects a tab in a generally radially-outward direction with respect to the disc immediately adjacent one face of the disc and in a timed relationship to the rotation thereof, the tab being projected into a tabbing recess provided in said one face of the disc to be inserted between the last and next sheets to be counted at the moment of projection of the tab.

The tabber and method of this invention is fundamentally different from those of the prior art, in that a tab no longer is inserted into the gap created between the sheets by the presence of the disc, but external to the disc and in a generally tangential direction. Instead, a tab is projected in a generally radially outward direction with respect to the disc across the central region thereof. To permit the tab to move in that direction between the disc itself and the next adjacent sheet of paper, a recess is provided in the disc so as to define a space within which the tab may be moved. Such a space is positively defined by the disc, rather than by having to rely on the flexibility of the paper in the region of the periphery of the disc. Moreover, it is possible accurately to time the projection of a tab with respect to rotation of the disc, so the tab enters the recess. In turn, this greatly minimises the likelihood of mis-tabbing or a paper-jam, and so the maximum counting speed when employing tabbing may be increased, as compared to prior art tabbers.

Preferably, the tabbing recess is provided in the face of the disc which lies against the last sheet to be counted, following the transfer of that sheet through the transfer slot of the disc from the opposed face. Then, immediately after the counting of the nth sheet but before the picking-up of the (n+1)th sheet, the tab is projected into the recess so accurately marking the stack to show that there are n sheets on the counted paper side of the tab.

In order more positively to define the space into which a tab is projected and to minimise the likelihood of friction between a projected tab and the next sheet to be counted, it is preferred that there is a cover provided on the disc and which partially overlies the recess. Such a cover may be attached to the disc along the leading edge of the recess, having regard to the intended direction of rotation of the disc. By having the circumferential extent of the cover less than that of the recess, an exit slot is formed at the trailing edge of the cover for a projected tab, so as to leave the tab between the counted sheets and the next sheet to be counted, immediately before that sheet is transferred through the slot and counted. Alternatively, the circumferential extent of the cover may be greater than that of the recess, the trailing edge of the cover then being raised out of the general plane of the disc thereby to form an exit slot for a projected tab.

In addition, the radial extent of the cover preferably is less than that of the recess, with the radially outer edge of the cover spaced inwardly of the disc periphery. In this way, there will be both an entry slot for a tab being projected into the recess and a projection slot from that recess for a tab as it becomes fully projected so as then frictionally to engage between the last and next sheets to be counted.

In a preferred embodiment, the tab is projected at an acute angle to the general plane of the disc, against the counted-sheet surface of the disc—said one face of the disc. The disc will then bend the tab round as the tab enters the recess, to be guided to lie between the sheets.

The disc advantageously has a plurality of transfer slots spaced therearound. In this case, there should be a tabbing recess in said one face of the disc between each pair of transfer slots. Thus, a tab may be inserted between any two sheets, whenever the count reaches the required value.

The tabber may include a source of tape for forming the tabs, such as a paper tape reel holder on which a reel of tape may be mounted, a tape drive mechanism and a guillotine arranged to cut from the tape a projected length thereof, following operation of said drive mechanism. Such a mechanism may comprise a pair of rolls defining a nip through which the tape passes and a drive arrangement for at least one of the rolls and operable to cause a length of tape to be projected in a timed relationship with respect to the rotation of the disc. Preferably, such a drive arrangement is adjustable to permit a tab accurately to be projected into a recess, despite different counting speeds. Such adjustment may be performed automatically, depending upon the counting speed.

In order to provide a timing signal for operation of the drive arrangement, a sensor may be associated with the disc and which provides a trigger output. For example, such a sensor may include an optical encoding disc together with a reader for that disc, which encoding disc is secured to the spindle supporting the counting disc. Alternatively operation of the tabber may be triggered by the required count signal, and in this case the sensor may simply provide a speed-sensing signal.

The counting apparatus of this invention could be arranged to engage either an edge region of a stack of sheets, partway along the length of a side of each sheet, or preferably a corner region of the stack. In one embodiment, there is provided a frame which supports the disc for rotation and means to hold a stack of sheets to be counted, the holding means being adapted to present to the disc the required part of the stack—and usually the corner region. One of the holding means or the disc should be arranged for movement relative to the other and the preferred arrangement is for the disc to be mounted for generally vertical movement while the stack remains stationary. The counting disc may be arranged to count from the bottom of the stack upwardly, with tabbing being performed as required during a counting operation. This has the advantage that the tabbing remnant (i.e. a number of sheets less than the number to be counted for each tabbing operation) will be at the top of the counted stack.

By way of example only, one specific embodiment of counting apparatus constructed and arranged in accordance with this invention and intended for the counting of bank note paper, with the insertion of tabs at predetermined counts, will now be described in detail, reference being made to the accompanying drawings, in which:

FIGS. 1A, 1B and 1C diagrammatically illustrate the three stages of a counting and tabbing operation in accordance with this invention;

FIGS. 2A, 2B and 2C diagrammatically illustrate cross-sections through the peripheral region of the counting disc and showing tab insertion, these Figures corresponding respectively to FIGS. 1A, 1B and 1C;

FIG. 3 is an isometric view on the counting and tabbing units of the embodiment of counter;

FIG. 4 corresponds to FIG. 3 but with the counting unit separated from the tabbing unit;

Figures 1A, 1B, 1C, 2A, 2B, 2C:
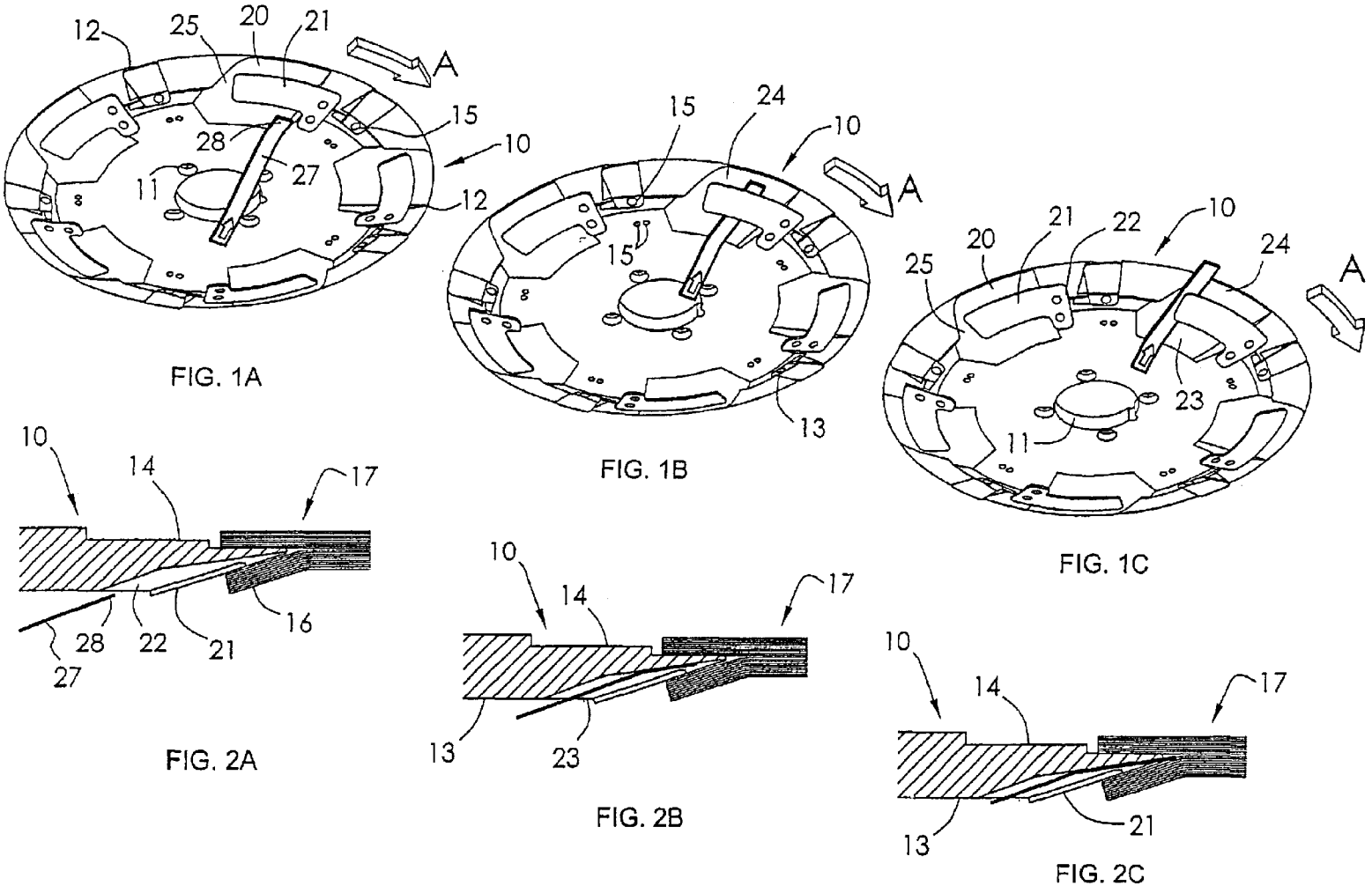
Figure 3:
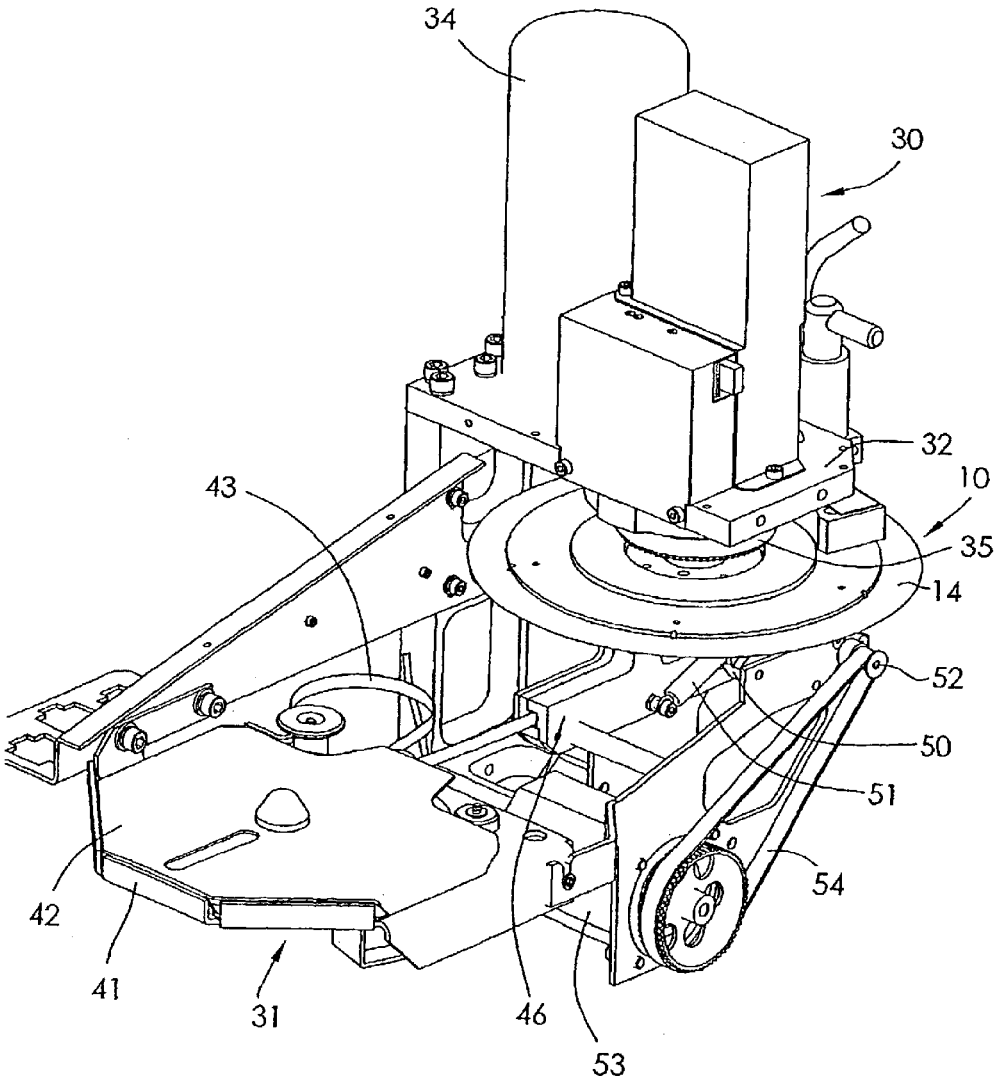
Figure 4:
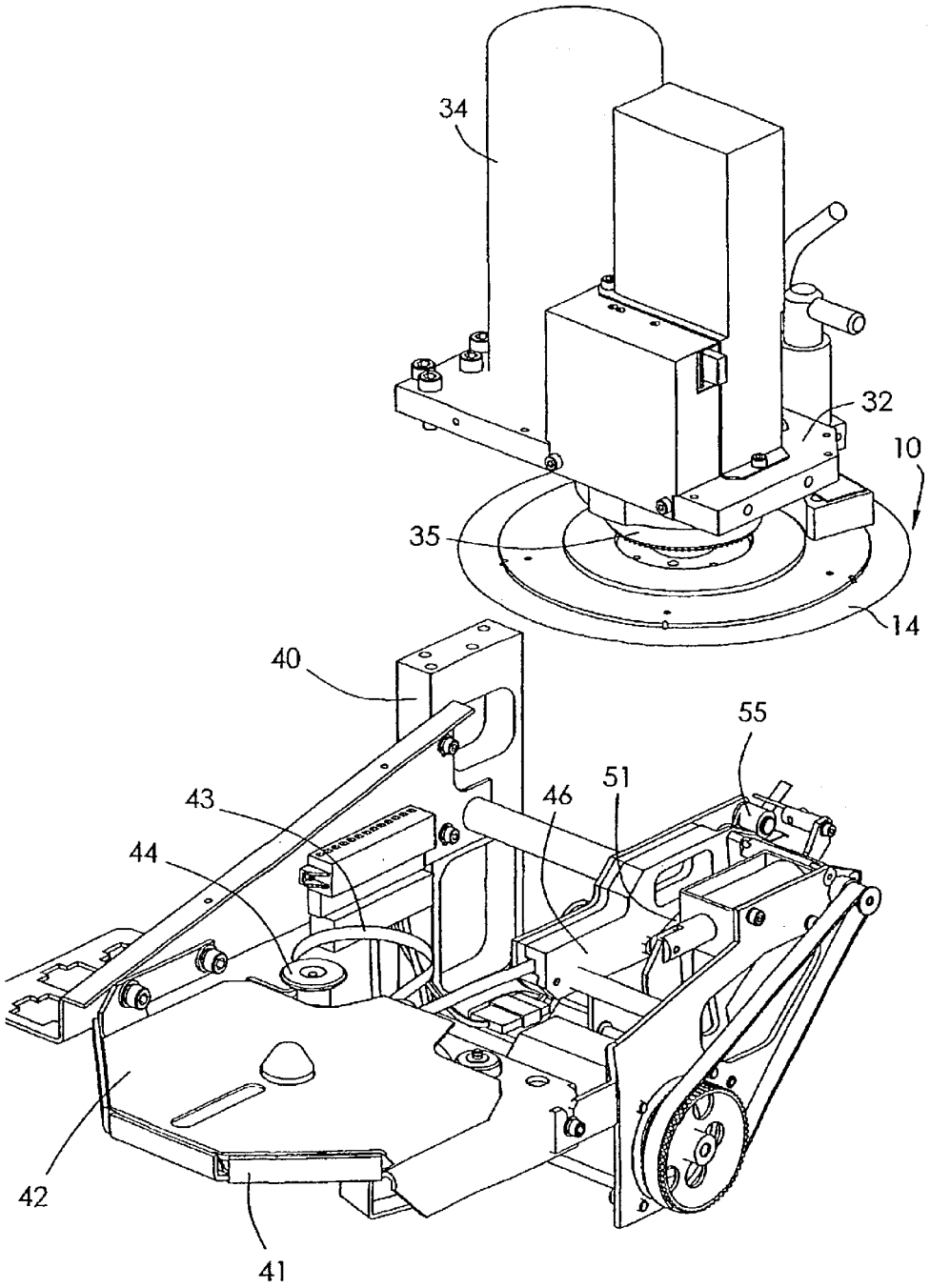

Referring initially to FIGS. 1 and 2, there is shown a counting disc 10 adapted for mounting on a drive spindle passing through a central bore 11. Formed around the periphery of the disc 10 are five sheet transfer slots 12, leading from the upper face 14 of the disc to the lower face 13. Vacuum holes (not shown) are arranged on the upper surface of the disc, in the region of each transfer slot 12, air being drawn through those holes in a timed relationship to the rotation of the disc in the direction of arrow A, when in use to count sheets of paper. In a simple counting operation, the upper face 14 of the disc 10 is engaged with the lower face of the lowermost sheet 16 of a stack 17 of such sheets and the disc is then rotated in the direction of arrow A. Each sheet is picked up one at a time by the air drawn through the vacuum holes and is guided into a transfer slot 12, so as to move to the lower face 13 of the disc, a counter being incremented as this occurs by sensing a change in air pressure through a suitably positioned orifice. FIGS. 2A, 2B and 2C show such a counting operation, partway through. Sheet counting in this way using a counting disc is known per se in the art and will not be described in further detail here.

The disc 10 shown in FIG. 1 differs from conventional counting discs in that there are provided five tabbing recesses 20 disposed one between each pair of sheet transfer slots 12. Each tabbing recess has a respective cover 21 which partially overlies the respective recess 20, the cover being secured to the disc adjacent the leading edge of the tabbing recess having regard to the direction A of rotation. The part of the cover secured to the disc is let into the lower face 13 of the disc, so that there is a smooth transition from the lower face of the disc to the outer face of the cover 21.

Each cover 21 is shaped so as to have a lesser circumferential length and radial width than the corresponding dimensions of each tabbing recess, so that there is an entry slot 23 defined between the radially inner edge of a tabbing recess and its cover, a projection slot 24 between the radially outer edge of the cover and the outer periphery of the disc, and an exit slot 25 between the trailing edge of the cover 21 and the trailing edge of the recess 20.

FIGS. 1A & 2A, 1B & 2B and 1C & 2C respectively show the three stages of a tabbing operation using disc 10. A strip paper tab 27 is driven by a mechanism (described below) in a timed relation to the rotation of disc 10 and then is cut from a reel of tabbing material. At the start of the procedure, the radially outer end 28 of tab 27 lies closely adjacent the radially inner edges of the tabbing recesses. Then, when the required count has been achieved, the tab is driven by the mechanism to move the radially outer end 28 of the tab 27 forwardly with respect to the periphery of the disc, so pushing the tab into the recess 20 behind the cover 21, as shown in FIGS. 1B and 2B. The mechanism continues to project the tab 27 as shown in FIGS. 1C and 2C, until the radially outer end 28 of the tab lies beyond the periphery of the disc 10. By this time, the disc has rotated sufficiently far for the tab to start leaving the tabbing recess 20, out of the exit slot 25. Very shortly afterwards, the next sheet to be counted is transferred through the next trailing transfer slot 12 and so traps the tab 27 in the required position in the stack. Finally, once the tab is trapped by a few sheets, the tab is cut from the unused tabbing material.

Figure 9A:
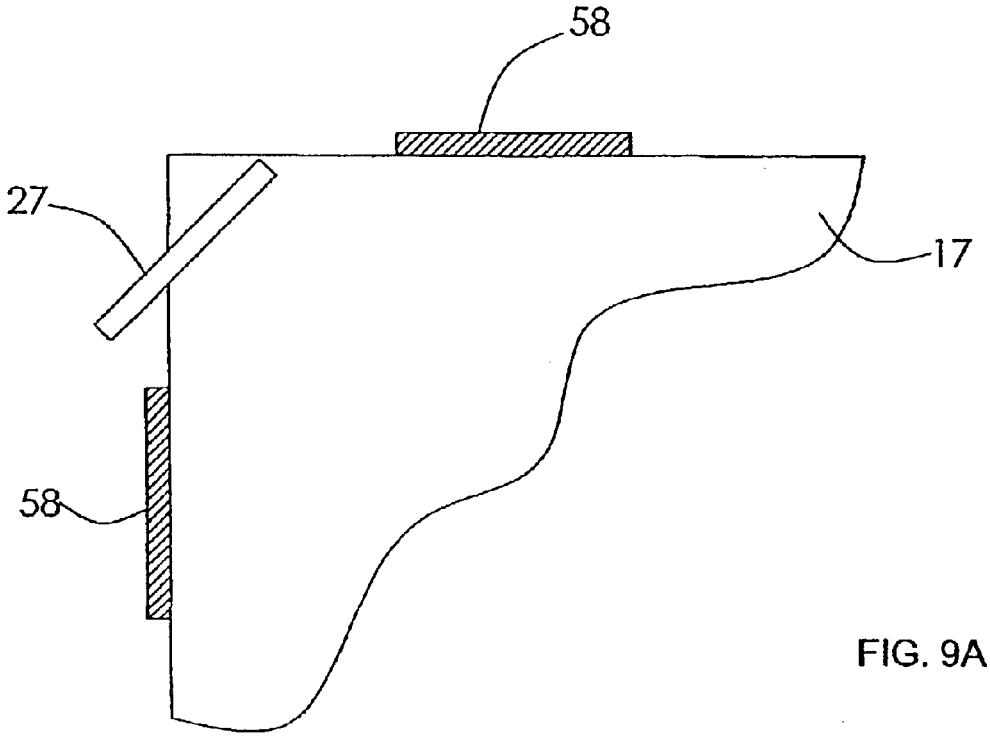
FIG. 9A illustrates the tabbing of a stack using a prior art tabber which inserts a tab externally of and tangential to a disc.
Figure 9B:
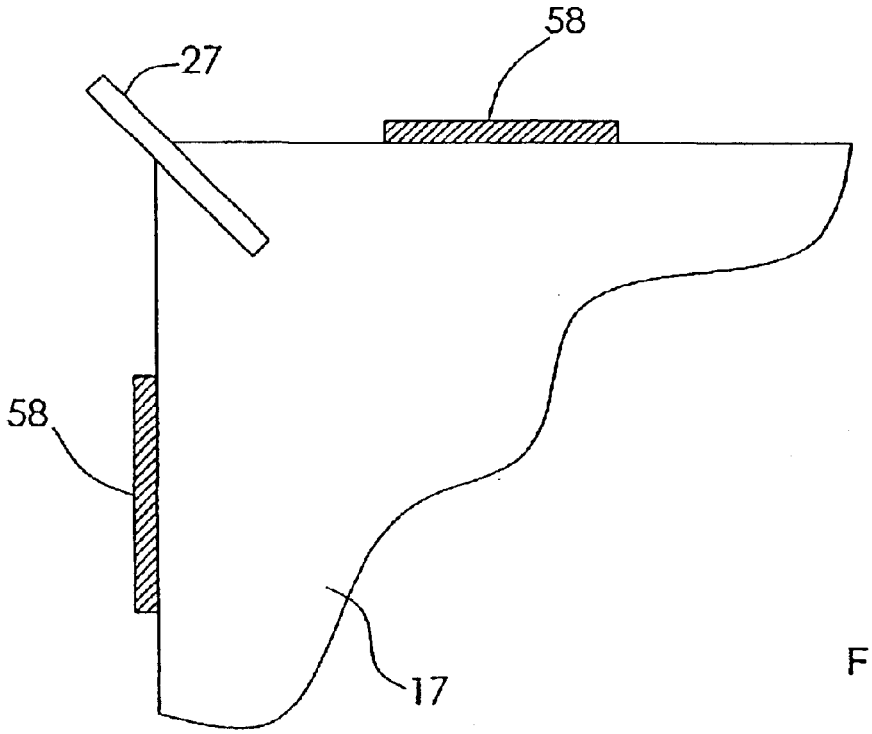
FIG. 9B illustrates tabbing using the apparatus of FIGS. 1 to 8.

Typically, the counting disc 10 is arranged to count across the corner region of the stack 17 of sheets. As a result of performing a tabbing operation on that stack, the tab 27 will generally bisect the corner angle between the edges of a sheet meeting at that corner, as shown in FIG. 9B. This may be contrasted with a prior art tabbing operation as shown in FIG. 9A, where a tab is projected generally tangentially to, and externally of, the counting disc. Such a tab is much less securely positioned within the stack, leaving aside issues of the reliability of the tabbing operation.

Referring now to FIGS. 3 to 8, there are shown counting and tabbing units 30 and 31, assembled together to perform the tabbing operation described with reference to FIGS. 1 and 2. The counting unit 30 comprises a base plate 32 which rotatably supports a spindle 33 for the disc 10, as well as a servo motor 34 drivingly coupled to the spindle 33 by means of a toothed belt drive 35. An optical encoding disc 36 is mounted on the spindle 33 for rotation with the counting disc 10, the precise angular position of the encoding disc 36 with respect to the counting disc 10 being adjustable by means of slots 37 through which pass clamping bolts 38. A pair of optical sensors 39 are associated with the encoding disc 36, so as to provide information concerning the speed of rotation of the disc and its instantaneous position, to an electronic controller (not shown). A vacuum supply arrangement (also not shown) is provided for the counting unit 30 for the disc 10, to connect the vacuum holes to an external low pressure source in a timed relation to the rotation of the disc, so as to ensure effective transfer of sheets through the slots 12 on rotation of the disc.

The counting unit 30 is mounted on a frame 40 which also supports the tabbing unit 31. This unit includes a carrier 41 for a cassette 42 holding a reel of paper tape 43 which tape is guided by rollers 44, 45 to a tape guide 46. A loop is maintained in the tape between those rollers 44, 45, to allow higher speed tab insertion, since the tape does not at that time have to be drawn from the reel.

Figure 5:
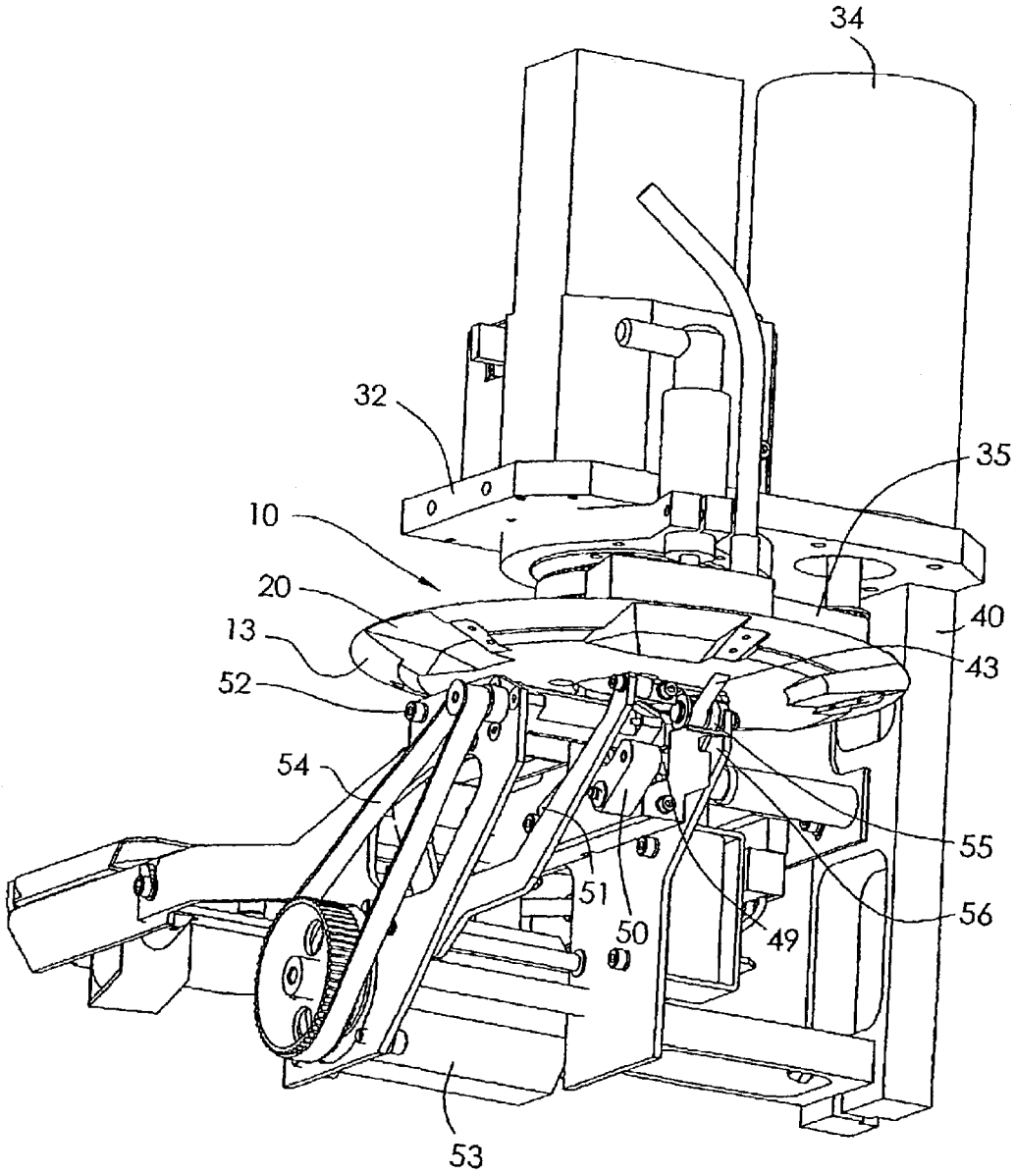
FIG. 5 is an isometric view of the counting and tabbing units, showing the forward end of the tabbing unit.
Figure 6:
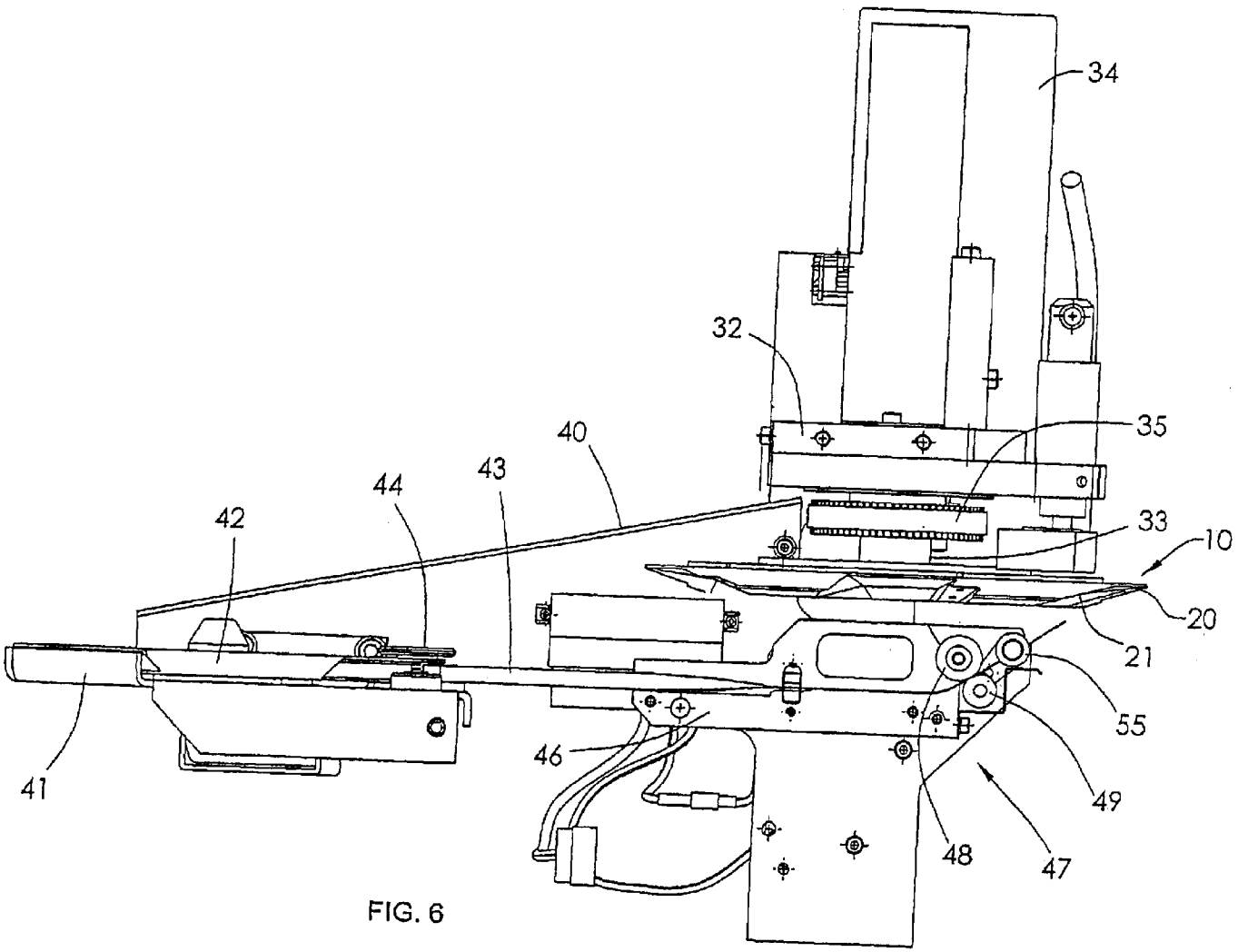
FIG. 6 is a side view on some of the important parts of the counting and tabbing units with various parts removed for clarity.
Figure 7:
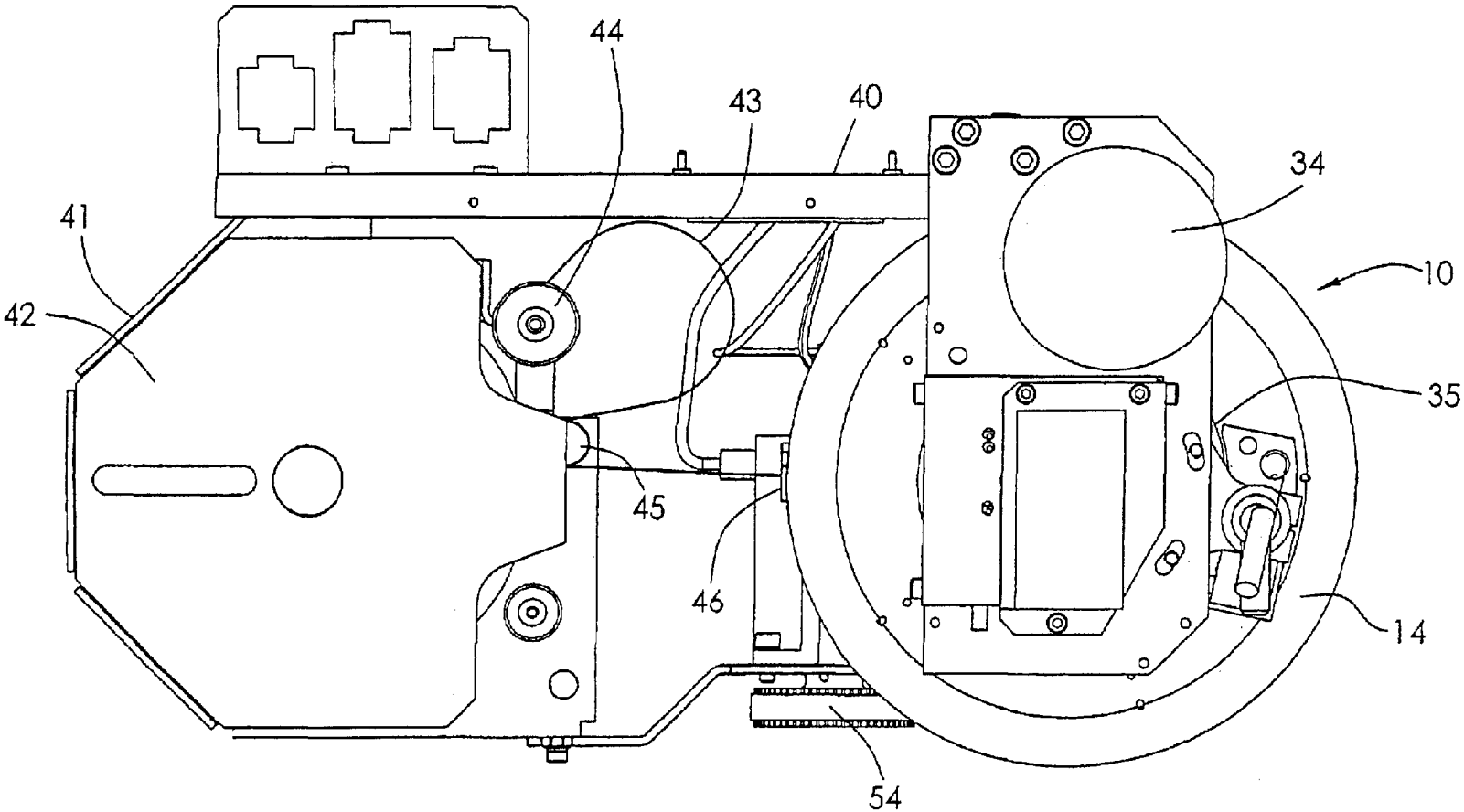
FIG. 7 is a plan view on the counting and tabbing units shown in FIG. 3, again with various parts removed for clarity.
Figure 8:
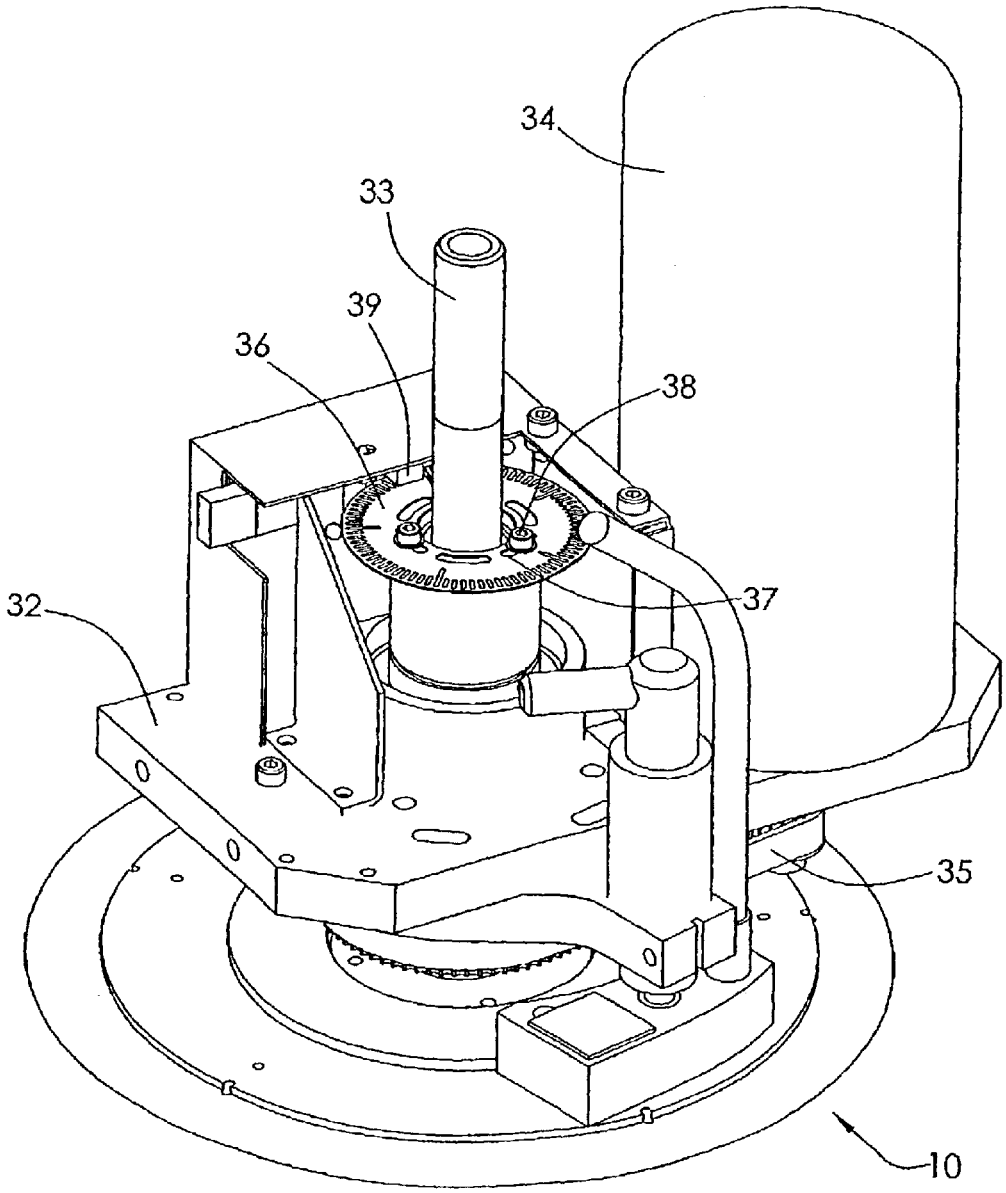
FIG. 8 is a partially cut away view of the counting unit.

Within the guide 46, the attitude of the tape is twisted through 90° so that it lies generally horizontally, before being guided to pass through a roller nip 47, defined by a drive roller 48 and a pressure roller 49. The pressure roller 49 is mounted on an arm 50 pivoted to the tape guide 46 and is urged into engagement with the drive roller 48 by a spring 51. The drive roller 48 is carried on a shaft 52 driven intermittently by a stepper motor 53 through toothed belt 54, the motor 53 being caused to operate when required by the electronic controller associated with the counting unit, when a particular count has been reached but timed in relation to the disc 10 rotation to ensure the tab 27 enters the next recess 20. Closely spaced ahead of the nip 47 is a rotary guillotine 55, the tape 43 passing therethrough as shown in FIGS. 5 and 6. The guillotine is operated by a solenoid (not shown) mounted on plate 56 forming a part of the frame 40, which solenoid is also driven by the electronic controller.

The counting and tabbing units 30, 31 are mounted on a carriage for generally vertical movement, within the overall counting and tabbing apparatus. That apparatus includes a table for supporting a stack of sheets to be counted, the table having guides 58 for the edges of the sheet adjacent the sheet corner region to be counted by disc 10 (FIG. 9B). The carriage supporting the counting and tabbing units is lowered to below the stack of sheets to be counted and then is raised until the upper face 14 of the disc engages the lowermost sheet 16 of the stack. The disc is then rapidly rotated, transferring the sheets one at a time through the counting slots 12, in a manner known per se, incrementing the count each time a sheet is transferred. During this action, the carriage is gradually raised so that the disc 10 will rise upwardly through the stack, carried on the table. Whenever a predetermined count has been reached (for example, every 100 sheets), then a tab 27 may be projected into the stack, between the 100th and 101st sheets, in the manner as has been described above with reference to FIGS. 1 and 2. The count continues to the top of the stack so that the tabbing remnant (i.e. a lesser number of sheets than those between tabs in the stack) is at the top of the stack, to be lifted off as required.

By inserting the tabs in accordance with this invention, and as shown in FIG. 9B, the tabs are inserted into a converging V-shaped opening in the stack of paper and this tends to trap the innermost ends of the tabs and so hold them more securely, as compared to the conventional arrangement as shown in FIG. 9A. Further, by projecting the tabs between two sheet corners following the separation of those corners by the counting disc, the disc itself acts as a divider between the sheet corners to ensure there is no ambiguity in the point of insertion. In addition, by having the tabs projecting from the stack as shown in FIG. 9B, there is a much smaller risk of the tabs being dislodged by the counting machine paper guides, when the stack of paper is withdrawn from the machine, as compared to having the tabs arranged as shown in FIG. 9A.

What is claimed is:

1. Counting apparatus for counting sheets in a stack thereof, which apparatus comprises a rotatable counting disc engageable with an edge region of the stack and including a sheet transfer slot to transfer the next sheet to be counted from one face of the disc to the opposed face on rotation of the disc, means to count the number of sheets transferred from one face to the other, advancing means to effect relative movement between the disc and the stack along the length of the stack as the sheets are counted, and a tabber arranged to insert a tab into the stack between two sheets when the count means achieves a predetermined sheet count value which tabber is arranged to project a tab in a generally radially-outward direction with respect to the disc, immediately adjacent one face of the disc and in a timed relationship to the rotation thereof, and the disc includes a tabbing recess in said one face and into which a projected tab is received for insertion between the last and next sheets to be counted at the moment of projection of the tab.

2. Counting apparatus as claimed in claim 1, wherein the tabbing recess is provided in the face of the disc which lies against the last sheet to be counted, following the transfer thereof through the transfer slot to the one face of the disc.

3. Counting apparatus as claimed in claim 1, wherein there is provided a cover which at least partially overlies the recess, a tab being projected into the space between the cover and the base of the recess.

4. Counting apparatus as claimed in claim 3, wherein the cover is attached to the disc along the leading edge of the recess, having regard to the intended direction of rotation of the disc.

5. Counting apparatus as claimed in claim 4, wherein the circumferential extent of the cover is less than that of the recess, whereby there is an exit slot for a projected tab at the trailing edge of the recess, having regard to the intended direction of rotation of the disc.

6. Counting apparatus as claimed in claim 4, wherein the circumferential extent of the cover is greater than that of the recess and the trailing edge of the cover is raised out of the general plane of the disc thereby to form an exit slot for a projected tab.

7. Counting apparatus as claimed in claim 3, wherein the radially outer edge of the cover is spaced inwardly of the disc periphery.

8. Counting apparatus as claimed in claim 1, wherein the disc has a plurality of transfer slots spaced therearound and between each pair of transfer slots, there is a tabbing recess in said one face of the disc.

9. Counting apparatus as claimed in claim 1, wherein the tabber includes a source of tape for forming tabs, a tape drive mechanism and a guillotine arranged to cut from the tape a length thereof projected from the tabber by said drive mechanism.

10. Counting apparatus as claimed in claim 9, wherein the drive mechanism comprises a pair of rolls defining a nip through which the tape passes, and a drive arrangement for at least one of the rolls operable to cause a length of tape to be projected in a timed relationship with respect to the rotation of the disc.

11. Counting apparatus as claimed in claim 1, wherein operation of the drive mechanism is triggered by an output from a sensor associated with the disc to detect disc rotation or a count signal from the count means.

12. Counting apparatus as claimed in claim 1, wherein there is provided a frame which supports the disc for rotation, and means to hold a stack of sheets to be counted, which holding means is adapted to present a corner region of the stack of sheets to the disc, for counting thereby.

13. Counting apparatus as claimed in claim 12, wherein the tabber is arranged with respect to the holding means such that a tab is projected with respect to a held stack into the corner region of the stack, generally to bisect the angle between the sides of the sheets which meet at the corner region.

14. Counting apparatus as claimed in claim 12, wherein the disc is arranged to move generally vertically upwardly with respect to a stack held by the holding means.

15. Counting apparatus as claimed in claim 1, wherein said one face of the disc and which contacts the last sheet to be counted is of shallow conical form, and the opposed face of the disc and which contacts the next sheet to be counted is of generally planar form and lies substantiality in a radial plane.

16. A method of tabbing sheets in a stack thereof using a rotatable counting disc engageable with an edge region of the stack and including a sheet transfer slot through which the next sheet to be counted is transferred from one face of the disc to the opposed face on rotation of the disc, the count being incremented each time a sheet is transferred from one face to the other and the disc being advanced along the length of the stack as the sheets are counted, in which method comprise:

using a tabber to insert a tab into the stack between two sheets when the count achieves a predetermined sheet count value which tabber projects a tab in a generally radially-outward direction with respect to the disc immediately adjacent one face of the disc and in a timed relationship to the rotation thereof; and timing the projection of the tab to enter a tabbing recess provided in said one face of the disc to be inserted between the last and next sheets to be counted at the moment of projection of the tab.

* * * * *